US009986599B2

(12) United States Patent
Gotoh et al.

(10) Patent No.: US 9,986,599 B2
(45) Date of Patent: May 29, 2018

(54) HEATING APPARATUS AND HEATING FURNACE

(71) Applicant: SANDVIK KK, Hyogo (JP)

(72) Inventors: Kazutaka Gotoh, Hyogo (JP); Hiroyuki Okamoto, Hyogo (JP); Satoshi Sugai, Hyogo (JP)

(73) Assignee: SANDVIK KK, Hyogo (JP)

( * ) Notice: Subject to any disclaimer, the term of this patent is extended or adjusted under 35 U.S.C. 154(b) by 23 days.

(21) Appl. No.: 15/033,194

(22) PCT Filed: Oct. 30, 2014

(86) PCT No.: PCT/JP2014/005515
§ 371 (c)(1),
(2) Date: Apr. 29, 2016

(87) PCT Pub. No.: WO2015/064111
PCT Pub. Date: May 7, 2015

(65) Prior Publication Data

US 2016/0255680 A1 Sep. 1, 2016

(30) Foreign Application Priority Data

Oct. 30, 2013 (JP) ..... 2013-225852

(51) Int. Cl.

| | |
|---|---|
| ***H05B 1/02*** | (2006.01) |
| ***H05B 3/62*** | (2006.01) |
| ***C21D 9/00*** | (2006.01) |
| ***H05B 3/26*** | (2006.01) |
| ***H05B 3/28*** | (2006.01) |

(Continued)

(52) U.S. Cl.
CPC ..... *H05B 3/62* (2013.01); *C21D 1/40* (2013.01); *C21D 9/0043* (2013.01); *F27D 11/02* (2013.01); *H05B 3/0014* (2013.01); *H05B 3/12* (2013.01); *H05B 3/141* (2013.01); *H05B 3/16* (2013.01); *H05B 3/265* (2013.01); *H05B 3/283* (2013.01);

(Continued)

(58) Field of Classification Search
CPC ..... H05B 3/62; H05B 3/0014; H05B 3/12; H05B 3/14; H05B 3/16; H05B 1/265; H05B 1/283; H05B 1/66; C21D 1/40; F27D 99/0008
USPC ..... 219/531, 544, 548, 494, 497
See application file for complete search history.

(56) References Cited

U.S. PATENT DOCUMENTS 4,154,975 A 5/1979 Sauder
5,714,738 A * 2/1998 Hauschulz ..... F16L 53/005 138/33

(Continued)

FOREIGN PATENT DOCUMENTS

EP 0424818 A1 5/1991
JP 2000351677 A 12/2000

(Continued)

*Primary Examiner* — Mark Paschall
(74) *Attorney, Agent, or Firm* — Corinne R. Gorski

(57) ABSTRACT

A heating apparatus, which can stably fix a heater and be easily produced, includes a heat insulating material and an electric heater embedded in the surface or near the surface of the heat insulating material. At least one hook extends from the electric heater into the heat insulating material. The heat insulating material is formed of ceramic fibers and a binder binding the ceramic fibers, and is integrally molded with the electric heater having the hook.

9 Claims, 8 Drawing Sheets

(51) Int. Cl.

| | |
|---|---|
| ***H05B 3/66*** | (2006.01) |
| ***H05B 3/12*** | (2006.01) |
| ***F27D 11/02*** | (2006.01) |
| ***C21D 1/40*** | (2006.01) |
| ***H05B 3/00*** | (2006.01) |
| ***H05B 3/14*** | (2006.01) |
| ***H05B 3/16*** | (2006.01) |
| *F27D 99/00* | (2010.01) |

(52) U.S. Cl.
CPC ..... *H05B 3/66* (2013.01); *F27D 2099/0008* (2013.01); *H05B 2203/003* (2013.01)

(56) References Cited

U.S. PATENT DOCUMENTS

| | | | | |
|---|---|---|---|---|
| 8,507,832 | B2 * | 8/2013 | Gueugnaut | B29B 13/024 138/98 |
| 2011/0068091 | A1 * | 3/2011 | Hiura | F23Q 7/001 219/270 |

FOREIGN PATENT DOCUMENTS

| | | | |
|---|---|---|---|
| JP | 2002372381 | A | 12/2002 |
| JP | 2004308941 | A | 11/2004 |
| JP | 2005121245 | A | 5/2005 |
| JP | 2005129273 | A | 5/2005 |
| JP | 2005150101 | A | 6/2005 |

* cited by examiner (a)

(b)

(a)

(b)

HEATING APPARATUS AND HEATING FURNACE

RELATED APPLICATION DATA

This application is a § 371 National Stage Application of PCT International Application No. PCT/JP2014/005515 filed Oct. 30, 2014 claiming priority of JP Application No. 2013-225852, filed Oct. 30, 2013.

TECHNICAL FIELD

The present invention relates to a heating apparatus for heating a heating furnace, and a heating furnace using the heating apparatus.

BACKGROUND ART

Conventionally, an electric heater used in a high-temperature heating furnace at 700 degree C. or more, particularly 1,000 degree C. or more, is fixed to the surface of a heat insulating material by a staple or a locking pin so as to enable direct heating of the inside of the furnace.

More specifically, as shown in FIG. 9, in the heating apparatus 90 of the prior art, in order to fix an electric heater 2 on the surface of a heat insulating material, a linear heater 2 is disposed in a meander configuration on the surface of a heat insulating material 1, and then ceramic-made pins 3 are inserted into the heat insulating material 1 at the curved portions, or metal-made staples 5 are inserted into the heat insulating material 1 so as to clip the linear heater 2. In the embodiment of FIG. 9, end parts of the linear heater 2 are connected to electrode terminals 4, and the electrode terminals 4 penetrate a through hole provided in the heat insulating material 1 to communicate with the back side.

Such an electric heater has a problem that deformation or sagging readily occurs at a high temperature other than at the fixed points, or repetition of heating/cooling is likely to cause a drop-off. Further, Such an electric heater has not only a problem that the life is short, but also a problem that pin driving or staple driving imposes a large load on the manufacturing process.

In order to solve this problem, a method of fixing an electric heater by embedding or inserting a part of the electric heater into a heat insulating material of felt-formed fiber has been proposed (Patent Documents 1 and 2).

However, in such a method, the stability of the electric heater is still insufficient, or there is room for improvement in terms of the load on the manufacture thereof.

CITATION LIST

Patent Literature

PTL 1: JP2002-372381A
PTL 2: JP2005-129273A

SUMMARY OF INVENTION

Solution to Problem

Under these circumstances, an object of the present invention is to provide a heating apparatus which solves the problems in conventional techniques, and a heating furnace provided with the heating apparatus.

Means to Solve the Problems

In order to attain the above-described object, the present invention provides the followings.

<1> A heating apparatus, wherein said heating apparatus comprises a heat insulating material, an electric heater embedded in the surface or near the surface of said heat insulating material, and a hook extending from said electric heater into said heat insulating material, wherein said heat insulating material is formed of ceramic fibers and a binder binding the ceramic fibers, and is integrally molded with said electric heater having said hook.

<2> The heating apparatus according to the aspect <1> above, wherein the apparatus further comprises an electrically insulating support member embedded in said heat insulating material, and said electrically insulating support member supports said hook in said heat insulating material.

<3> The heating apparatus according to the aspect <1> or <2> above, wherein said electric heater is formed in a meander configuration by providing alternate slits in a metal plate from both side edges thereof, the portion forming said slit of said metal plate is bent from said metal plate to form a plurality of alternately opposing hooks.

<4> The heating apparatus according to the aspect <3> above, wherein said alternately opposing hooks in rows on both sides are supported by one electrically insulating support member.

<5> The heating apparatus according to the aspect <3> above, wherein said alternately opposing hooks in each row are supported by each of separate insulating support members.

<6> The heating apparatus according to any one of the aspects <1> to <5> above, wherein said electric heater comprises a plurality of metal plates formed in a meander configuration, and said plurality of metal plates in a meander configuration are interconnected by welding.

<7> The heating apparatus according to any one of the aspects <1> to <6> above, wherein the surface of said heater is flush with the surface of said heat insulating material.

<8> The heating apparatus according to any one of the aspects <1> to <7> above, wherein said electrically insulating support member is a hollow body, the apparatus further comprises a heat-resistant member penetrating through the hollow part of the said electrically insulating support member, and said heat-resistant member extends outside of said heat insulating material.

<9> The heating apparatus according to the aspect <9> above, wherein said heat-resistant member is made of ceramic or a metal.

<10> A heating furnace having the heating apparatus according to any one of the aspects <1> to <9> above.

MODE FOR CARRYING OUT THE INVENTION

<<Heating Apparatus>>

Figure 1:
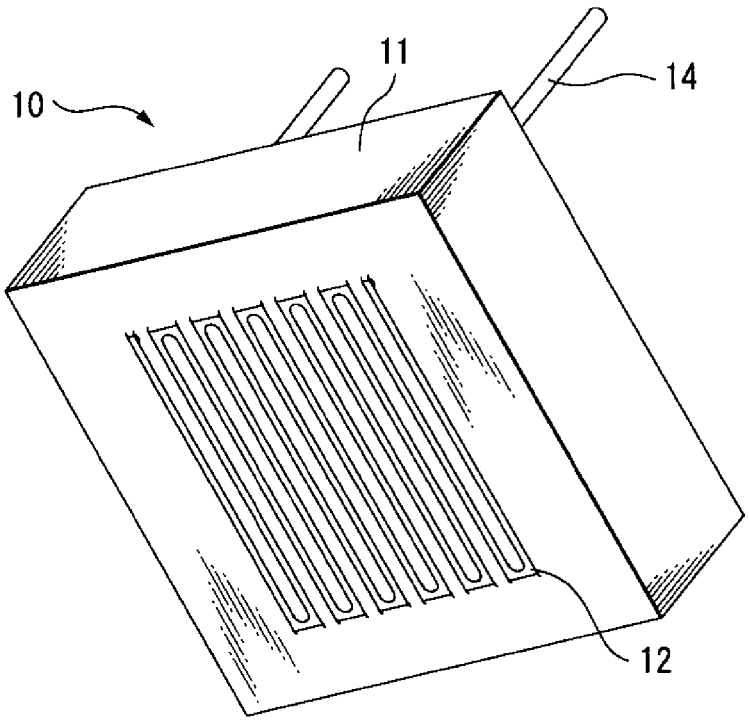
FIG. 1 A perspective view of the first embodiment of the heating apparatus of the present invention, which is observed from the heater side.

The heating apparatus of the present invention comprises a heat insulating material, an electric heater embedded in the surface or near the surface of the heat insulating material, and a hook extending from the electric heater into the heat insulating material. The heat insulating material is formed of ceramic fibers and a binder binding the ceramic fibers, and is integrally molded with the electric heater having the hook.

According to the heating apparatus of the present invention, deformation and drop-off of the heater can be prevented with an uncomplicated manufacture process, since the heat insulating material is integrally molded with the electric heater so as to the hook extends into the heat insulating material, i.e. since, during the molding of the heat insulating material, the insulating material and the electric heater is bonded and integrated.

Incidentally, in order to enhance the effect of anchoring the hook to the heat insulating material, it is preferable to increase the surface area of the parallelly bent portion at the end of the hook or to increase the number of hooks.

Further, according to the heating apparatus of the present invention, the distance between adjacent heaters can be decreased, and thereby in-plane density of the electric heater can be increased, since deformation of the electric heater can be prevented.

Further, according to the heating apparatus of the present invention, the heat insulating material panel can be made thin and/or small, since a margin for inserting pins or staples is not necessary.

The surface of the electric heater may be flush with the surface of the heat insulating material, may be embedded below the surface heat insulating material, or may be protruded from the surface of the heat insulating material.

If the surface of the electric heater is flush with the surface of the heat insulating material, or is embedded below the surface heat insulating material, the surface of the electric heater is not protruded from the surface of the heat insulating material, so that the to-be-heated body can be put close to the electric heater surface, leading to improvement of uniform heating characteristics.

The heating apparatus of the present invention may be a flat panel-shaped one, or one for a cylindrical muffle furnace.

The heating apparatus of the present invention can be produced, e.g. by a cast molding method, vacuum molding method, or the like, and a vacuum molding method is preferred.

When the heating apparatus of the present invention is produced with a vacuum method, for example, a suction device connected to a vacuum pump and a forming die disposed thereon are placed in a tank, and a slurry obtained by dissolving or dispersing ceramic fibers in a binder is housed in the tank. The top of the suction device connected to a vacuum pump has a net shape, and therefore the inside of the forming die disposed thereon can be vacuum-suctioned. In the state where the electric heater having a hook, and the optional electrically insulating support members are disposed at predetermined positions in the forming die, vacuum is applied into the forming die through the vacuum pump and the suction device, as a result, the ceramic fibers and binder are suctioned and deposited on the net-shaped bottom in the forming die to be formed into the shape of the heat insulating material.

At this time, the ceramic fibers and binder forming the heat insulating material are integrally molded so as to arrange the electric heater as the bottom and include (embed) the electric heater, the hook and the electrically insulating support members. By taking the heat insulating material molded out of the tank and drying it, the binder binds the ceramic fibers, and thus a heat insulating material including (embedding) the electric heater, and the electrically insulating support members is integrally molded.

In the heat insulating material thus obtained by an integral molding method, the bottom is flush with the surface of the electric heater, and basically, the electric heater having the hook are put into close contact with the heat insulating material, and the optional electrically insulating support members are put into close contact with the heat insulating material.

Incidentally, although the slurry is sometimes thinly attached to the surface of the electric heater, the slurry may be left attached as it is, or may be removed to completely expose the electric heater. It is also possible to intentionally embed the surface of the electric heater.

<Heat Insulating Material>

The heat insulating material is a molded body comprising ceramic fibers and a binder binding the ceramic fibers. Alumina-silica fiber can be used as a ceramic fiber, and colloidal silica can be used as the binder.

Further, for molding of the heat insulating material, slurry comprising water as a solvent, as well as the ceramic fibers and the binder, can be used.

<Electric Heater>

The electric heater used in the heating apparatus of the present invention can have any configuration. For example, the electric heater is formed in a meander configuration by providing alternate slits in a metal plate from both side edges thereof, the portion forming the slit of the metal plate is bent from the metal plate to form a plurality of alternately opposing hooks.

If the hook is formed in this way by utilizing an extra portion (slit portion) of the metal plate forming the electric heater of a meander configuration, an extra material for forming the hook is not necessary. Further, in this case, a hook is formed in each turn of the meandering path, leading to an effect that the electric heater can be stably held.

The alternately opposing hooks in rows on both sides may be supported by one electrically insulating support member, or the alternately opposing hooks in each row may be supported by each of separate insulating support members, i.e. may be supported by total two insulating support members.

The electric heater may comprise a plurality of metal plates formed in a meander configuration, and the plurality of metal plates in a meander configuration are interconnected by welding, optionally via a metal member of the same material as the electric heater. A plurality of metal plates formed in a meander configuration may be formed of a single metal plate.

As the electric heater, a metal-made heater is preferred, and for high-temperature heating, for example, NiCr, FeCrAl, Mo and W may be used. Particularly, FeCrAl allowing for high-temperature heating and excellent also in the oxidation resistance is preferred.

<Electrically Insulating Support Member>

The heating apparatus of the present invention further may comprise an electrically insulating support member embedded in the heat insulating material, and the electrically insulating support member may support the hook in the heat insulating material. In other words, the electrically insulating support member is a member for holding the hook of the electric heater to stably hold the electric heater.

Drop-off of the electric heater can be further prevented by supporting the hook of the electric heater by the electrically insulating support member.

The shape of the electrically insulating support member is not limited, as far as the member itself is embedded in the heat insulating material and holds the hook, and thereby stabilize the holding of the electric heater in comparison with the case wherein the electric heater is held only by the hook.

The electrically insulating support member having a rod shape is simple and preferred in order to hold a hook of the electric heater, e.g. to hold a series of hooks formed in the slit portions of the electric heater in a meander configuration. The shape and size may be the same or different between the electrically insulating support members holding two hook rows.

In the case where the hook is thus held by an electrically insulating support member, even when the area of the parallelly bent portion at the end of the hook is not increased, the hook, and in turn, the electric heater can be firmly held by the electrically insulating support member.

The electrically insulating support member is composed of an electrically insulating material. In view of heat resistance, the electrically insulating support member is preferably composed of a ceramic material such as alumina, mullite, sillimanite, zirconia, magnesia and silicon nitride is preferred.

The electrically insulating support members may be optionally formed in a hollow shape, and particularly a hollow tubular shape, whereby a heat-resistant member can be passed through it as described below.

<Heat-Resistant Member>

The electrically insulating support members may be optionally formed in a hollow shape, and particularly a hollow tubular shape, whereby a heat-resistant member can be passed through the hollow part to the outside of the heat insulating material.

By using the heat-resistant member, particularly rod-shaped heat-resistant member, the heating apparatus can be easily supported, and particularly can be easily held or fixed.

The heat-resistant ceramic may be made of ceramic or metal. The ceramic may be alumina, silicon nitride, etc. which are electrically nonconductive, or may be electrically conductive silicon carbide. The metal may be the same material as the electric heater.

The heating apparatus of the present invention is described below regarding the first to fifth embodiment, but the present invention is not limited thereto.

First Embodiment

Figure 2:
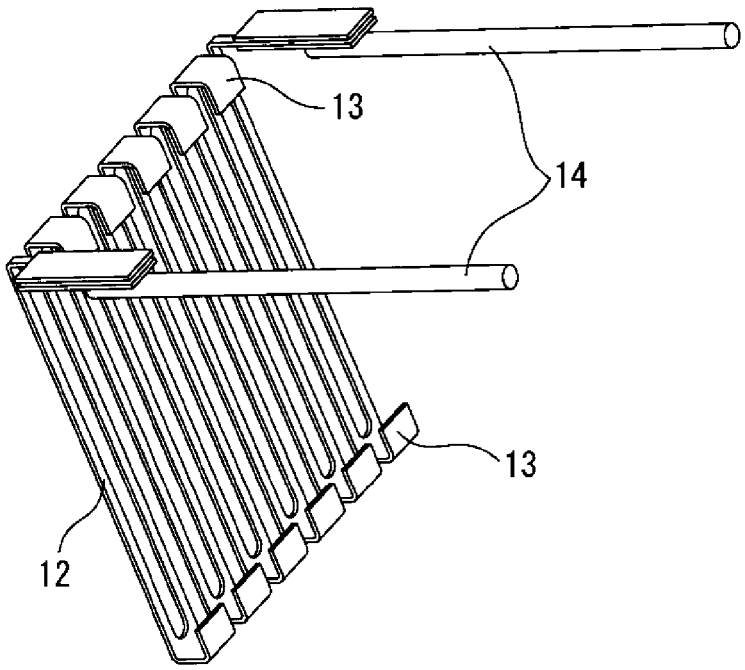
FIG. 2 A perspective view of the heater used in the first embodiment of the heating apparatus of the present invention, which is observed from the backside of the heater.

The first embodiment of the heating apparatus 10 of the present invention is described in FIGS. 1 and 2.

More specifically, FIG. 1 is a perspective view of the first embodiment of the heating apparatus of the present invention, which is observed from the heater side; and FIG. 2 is a perspective view of the heater used in the first embodiment of the heating apparatus of the present invention, which is observed from the backside of the heater.

As illustrated in FIGS. 1 and 2, in the heating apparatus 10, a part of an electric heater 12 is formed as a hook 13 extending toward the inside of a heat insulating material 11, and the electric heater 12 is integral molded with the heat insulating material 11. To end parts of the electric heater 12, electrode terminals 14 are connected.

The hook 13 of the electric heater 12 is formed to extend toward the inside of the heat insulating material 11 at the time of formation of the electric heater 12 in a meander configuration. In this heating apparatus 10, the heat insulating material 11 is molded integrally with the electric heater 12 having the hook 13, such that the heater 12 having the hook 13 is embed in the heat insulating material. The hook 13 not only extends from the electric heater 12 toward the inside of the heat insulating material 11, but also is bent at its end part in the direction parallel to the electric heater 12, and moreover, is molded integrally with the heat insulating material 11, and therefore the hook 13 is firmly fixed in the heat insulating material 11 and does not easily come off.

Furthermore, in the heating apparatus 10 of the present invention, the electric heater 12 is also molded integrally with the heat insulating material 11, and therefore is directly embedded and fixed in the heat insulating material 11, leading to a stabilization effect.

In addition, the electric heater 12 is flush with the surface of the heat insulating material 11 and is not protruded, so that a to-be-heated body can be disposed in the heating furnace to come close to the electric heater and the uniform heating characteristics can be improved.

Second Embodiment

Figure 3:
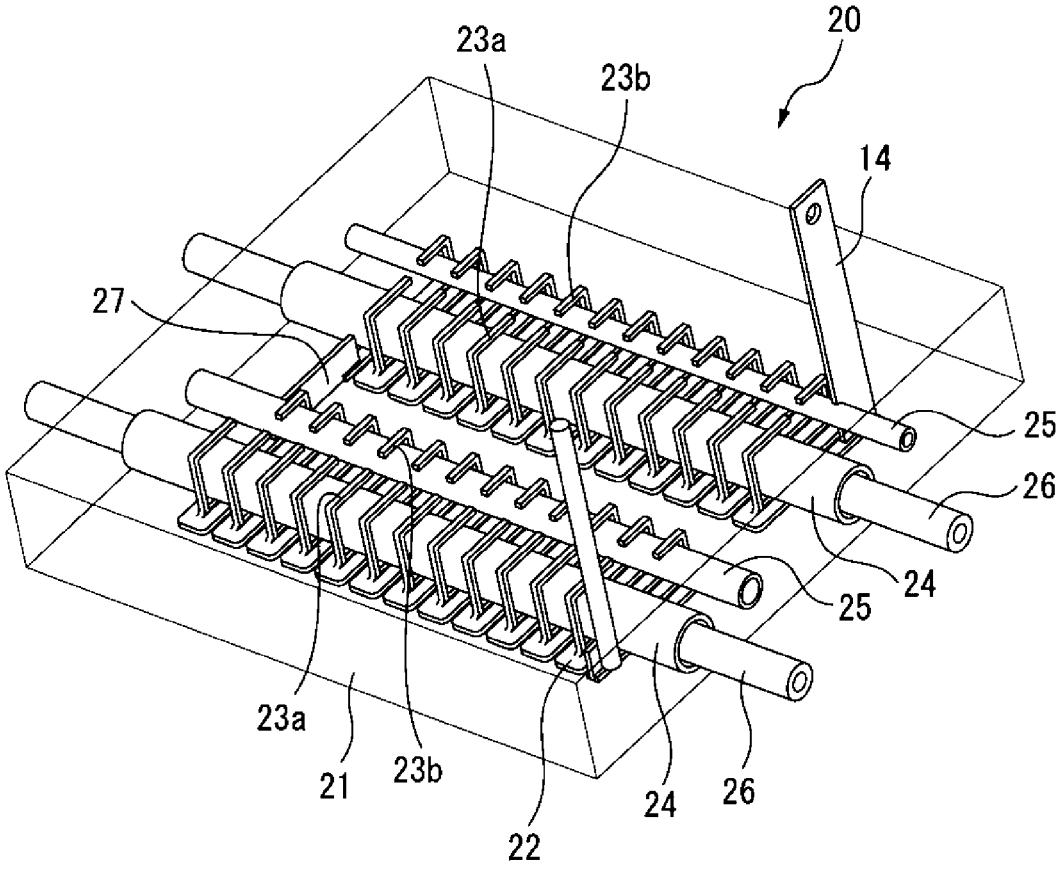
FIG. 3 A transparent perspective view of the second embodiment of the heating apparatus of the present invention, which is observed from the opposite side from the heater.
Figure 4:
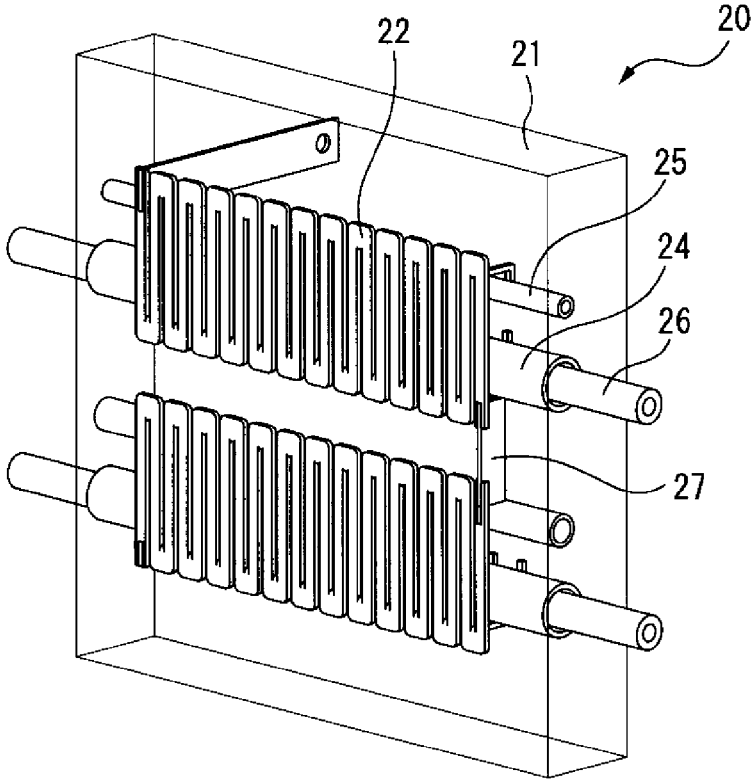
FIG. 4 (*a*) A transparent perspective view and (*b*) a perspective view of the second embodiment of the heating apparatus of the present invention, which is observed from the heater side.
Figure 4:
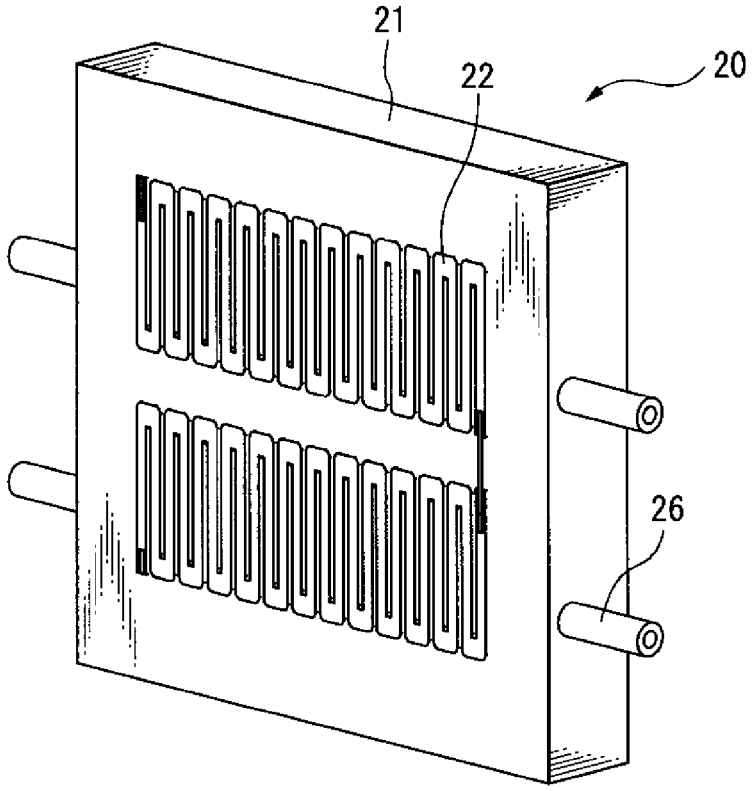
Figure 5:
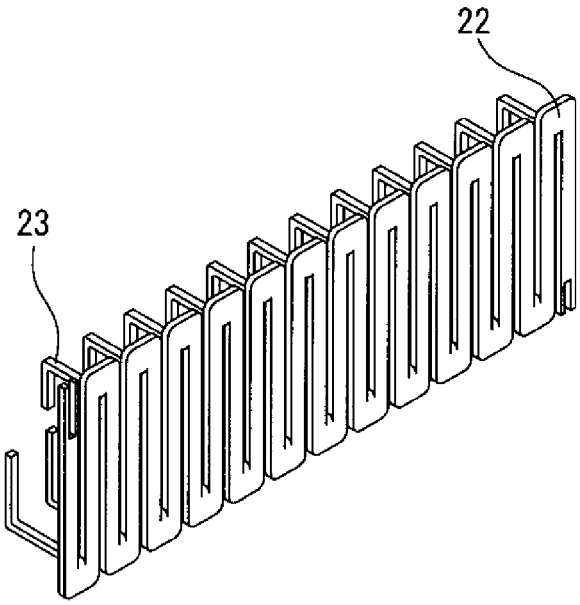
FIG. 5 A perspective view of the heater used in the second embodiment of the heating apparatus of the present invention, which is observed from (*a*) the heater side and (*b*) the backside of the heater.
Figure 5:
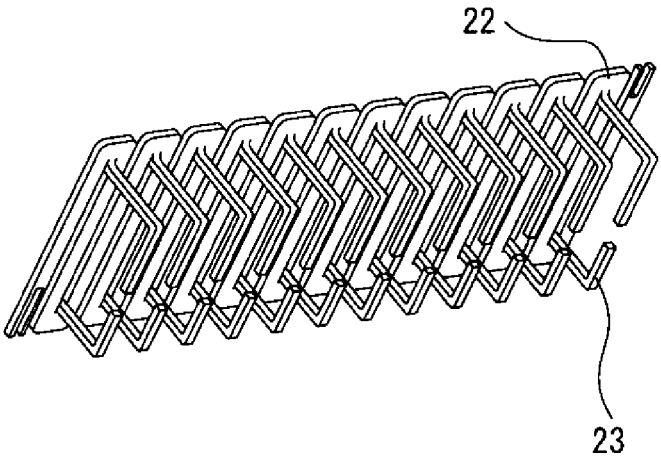

The second embodiment of the heating apparatus 20 of the present invention is described in FIGS. 3 to 5.

More specifically, FIG. 3 is a transparent perspective view of the second embodiment of the heating apparatus of the present invention, which is observed from the opposite side from the heater; FIG. 4 is (*a*) A transparent perspective view and (*b*) a perspective view of the second embodiment of the heating apparatus of the present invention, which is observed from the heater side; and FIG. 5 is a perspective view of the heater used in the second embodiment of the heating apparatus of the present invention, which is observed from (*a*) the heater side and (*b*) the backside of the heater.

In the heating apparatus 20, a heat insulating material 21, an electric heater 22 including a hook 23*a* and 23*b*, and electrically insulating support members 24 and 25 are integrally molded in the form that the hooks 23 extending from the electric heater 22 embrace the electrically insulating support members 24 and 25.

The electric heater 22 is shaped as a belt-like heater in a meander configuration by alternately forming slits from both side edges, and the metal portion forming the slit is bent to form hooks 23*a* and 23*b* respectively on both edge sides of the metal plate.

In this embodiment, two metal plates are used, each metal plate forming an electric heater in a meander configuration, and since these metal plates are usually interconnected by welding through a metal member 27 formed of the same material as the electric heater, the material is less wasted.

Each of two hook rows 23*a* and 23*b* formed respectively on both edge sides of each metal plate of the embodiment is held by one electrically insulating support member 24 or 25. In this way, two hook rows 23*a* and 23*b* in the width direction of the electric heater 22 are held by two electrically insulating support members 24 and 25, whereby there is produced an effect that the electric heater 22 is more stably held also in the width direction.

In this embodiment, one electrically insulating support member 24 is formed in a hollow tubular shape, whereby a rod-shaped heat-resistant ceramic- or metal-made member 26 can be passed through the hollow part. Outside of the heat insulating material 21, the rod-shaped heat-resistant member serves as means for holding or fixing the heating apparatus 20 in a heating furnace.

Third Embodiment

Figure 6:
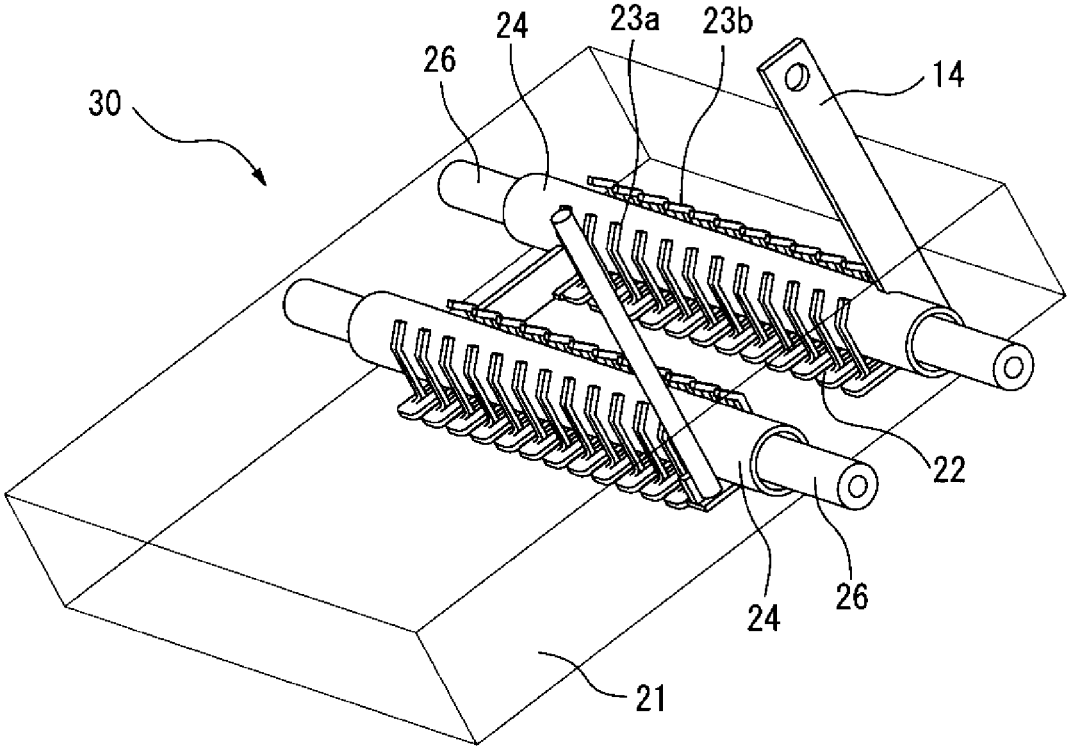
FIG. 6 A transparent perspective view of the third embodiment of the heating apparatus of the present invention, which is observed from the opposite side from the heater.

The third embodiment of the heating apparatus 30 of the present invention is described in FIG. 6. FIG. 6 is a transparent perspective view of the third embodiment of the heating apparatus of the present invention, which is observed from the opposite side from the heater.

This embodiment uses the electric heater 22 formed in a meander configuration from one metal plate, and one electrically insulating support member of hollow tubular shape is embraced by the hooks 23*a* and 23*b* in two rows extending from the electric heater 22.

Forth Embodiment

Figure 7:
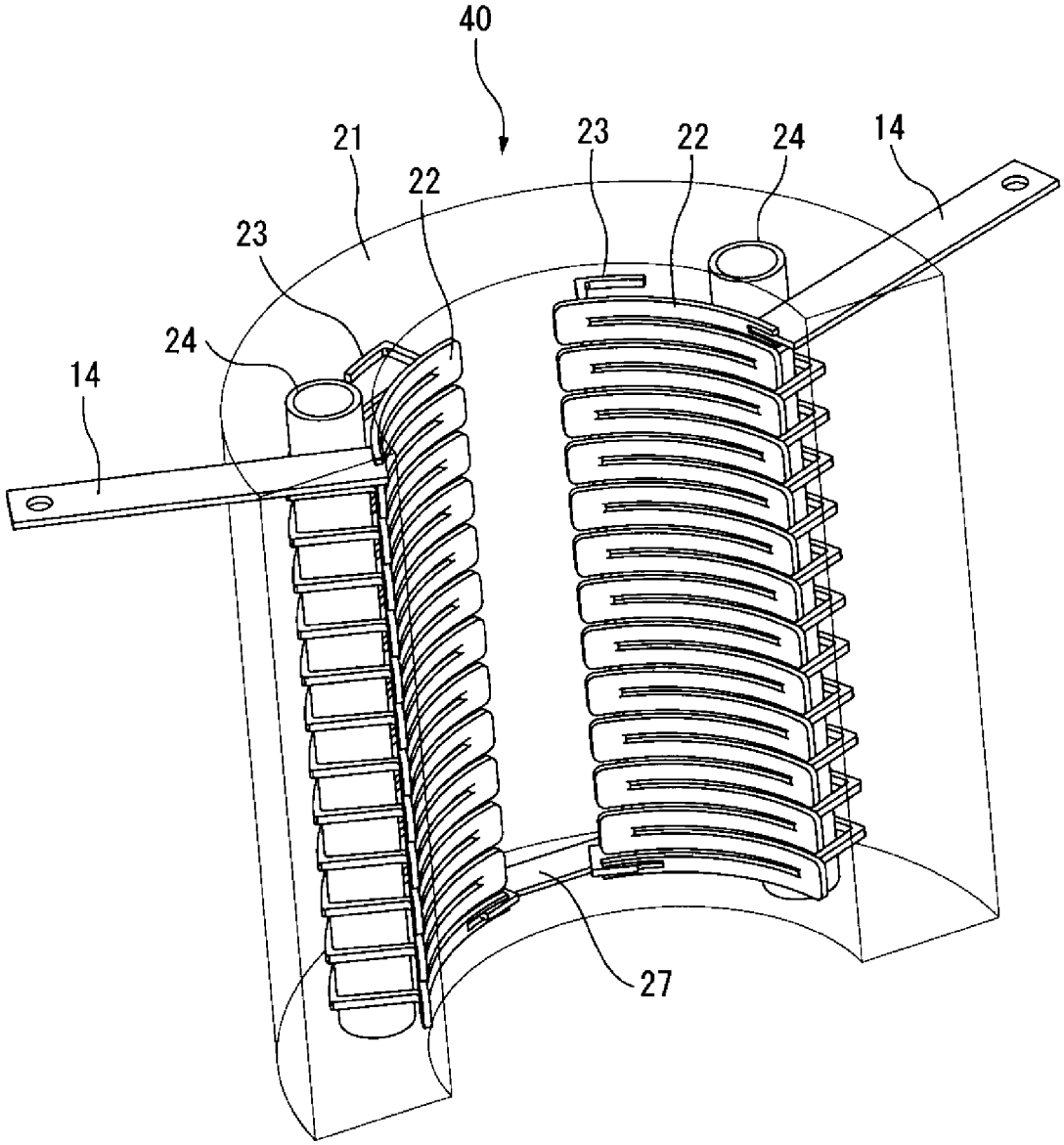
FIG. 7 A transparent perspective view of the fourth embodiment of the heating apparatus of the present invention, which is used for a cylindrical muffle furnace and observed from the heater side.

The forth embodiment of the heating apparatus 40 of the present invention is described in FIG. 7. FIG. 7 is a transparent perspective view of the fourth embodiment of the heating apparatus of the present invention, which is used for a cylindrical muffle furnace and observed from the heater side.

In this embodiment, only one electrically insulating support member 24 is used for one electric heater 22, and thus the cost can be reduced. However, in view of stability, two electrically insulating support members 24 can be used, as described above.

Fifth Embodiment

Figure 8:
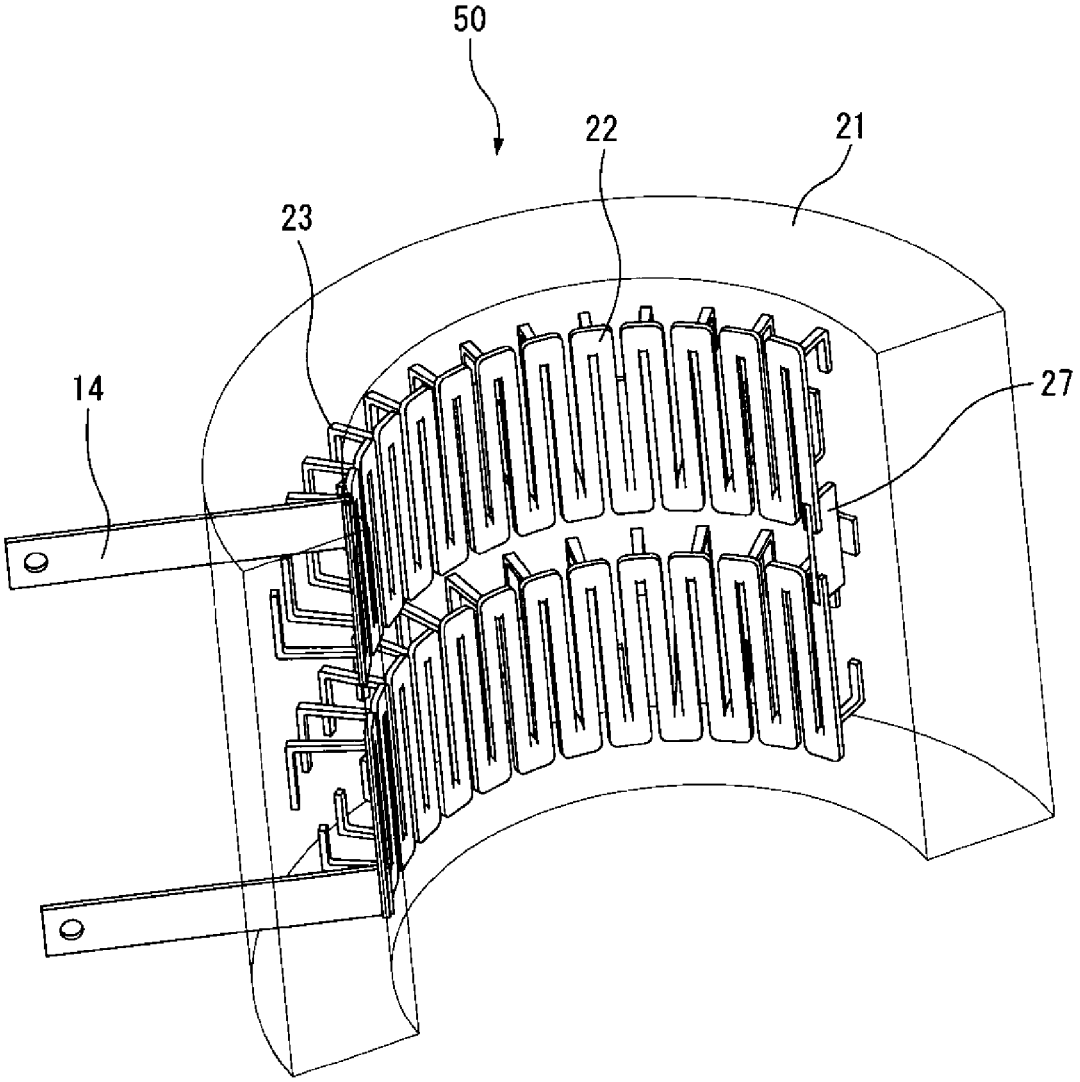
FIG. 8 A transparent perspective view of the fifth embodiment of the heating apparatus of the present invention, which is used for a cylindrical muffle furnace and observed from the heater side.
Figure 9:
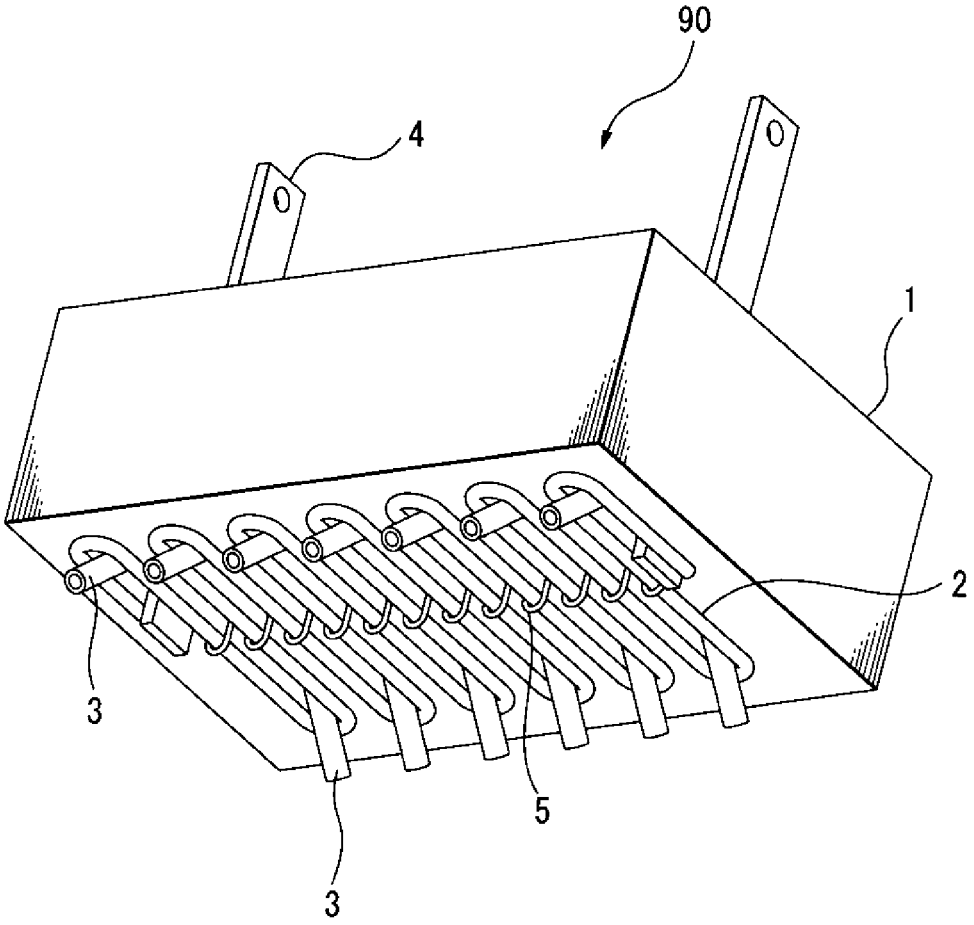
FIG. 9 A perspective view of the conventional heating apparatus, which is observed from the heater side.

The fifth embodiment of the heating apparatus 50 of the present invention is described in FIG. 8. FIG. 8 is a transparent perspective view of the fifth embodiment of the heating apparatus of the present invention, which is used for a cylindrical muffle furnace and observed from the heater side.

This embodiment is the same cylindrical muffle furnace as the forth embodiment illustrated in FIG. 7, but the bending direction of the electric heater differs from the forth embodiment illustrated in FIG. 7 by 90 degree. In this embodiment, the hook 23 extending from the electric heater 22 is not held by an electrically insulating support member 24, but may be held by an electrically insulating support member 24.

<<Heating Furnace>>

A heating furnace, for example cylindrical muffle furnace can be constructed using the heating apparatus of the present invention by a known method.

The invention claimed is:

1. A heating apparatus comprising:

a heat insulating material having a surface;

an electric heater embedded in the surface or near the surface of said heat insulating material;

a hook extending from said electric heater into said heat insulating material, wherein said heat insulating material is formed of ceramic fibers and a binder binding the ceramic fibers, and is integrally molded with said electric heater having said hook; and an electrically insulating support member embedded in said heat insulating material, wherein said electrically insulating support member supports said hook in said heat insulating material.

2. The heating apparatus according to claim 1, wherein said electric heater is formed in a meander configuration by providing alternate slits in a metal plate from both side edges thereof, the portion forming each of said slits of said metal plate is bent from said metal plate to form a plurality of alternately opposing hooks.

3. The heating apparatus according to claim 2, wherein said alternately opposing hooks in rows on both sides are supported by one electrically insulating support member.

4. The heating apparatus according to claim 2, wherein said alternately opposing hooks in each row are supported by each of the separate electrically insulating support members.

5. The heating apparatus according to claim 1, wherein said electric heater includes a plurality of metal plates formed in a meander configuration, wherein said plurality of metal plates in the meander configuration are interconnected by welding.

6. The heating apparatus according to claim 1, wherein a surface of said heater is flush with the surface of said heat insulating material.

7. The heating apparatus according to claim 1, wherein said electrically insulating support member is a hollow body, the apparatus further comprising a heat-resistant member penetrating through the hollow part of the electrically insulating support member, wherein said heat-resistant member extends outside of said heat insulating material.

8. The heating apparatus according to claim 7, wherein said heat-resistant member is made of ceramic or a metal.

9. A heating furnace having the heating apparatus according to claim 1.

* * * * *